United States Patent [19]

Parsons

[11] Patent Number: 4,533,800

[45] Date of Patent: Aug. 6, 1985

[54] REVERSIBLE ROTARY ACTUATOR

[75] Inventor: Gerald R. Parsons, Poplar Grove, Ill.

[73] Assignee: Barber-Colman Company, Rockford, Ill.

[21] Appl. No.: 559,716

[22] Filed: Dec. 9, 1983

[51] Int. Cl.[3] ..... H01H 3/16

[52] U.S. Cl. ..... 200/61.39; 310/68 B; 200/47

[58] Field of Search ..... 200/61.39, 81.9 R, 61.20, 200/47; 310/68 B; 318/466, 467, 468

*Primary Examiner*—A. D. Pellinen
*Assistant Examiner*—Morris Ginsburg
*Attorney, Agent, or Firm*—Leydig, Voit, Osann, Mayer & Holt, Ltd.

[57] ABSTRACT

A reversible electric motor supported on a sub-base acts through a reduction gear train to rotate an output shaft supported by a main mounting base, the sub-base being capable of turning through a limited range relative to the main base about the axis of the output shaft. When the output shaft encounters excessive resistance torque in either direction, the sub-base automatically turns relative to the main base and effects the opening of switch means to de-energize the motor.

10 Claims, 8 Drawing Figures

REVERSIBLE ROTARY ACTUATOR

BACKGROUND OF THE INVENTION

This invention relates to a reversible rotary actuator having an electric motor which is selectively operable to drive an output member in either of two directions. The output member may, for example, be a flow-controlling damper which is adapted to be turned between fully open and fully closed positions in an air duct. When the damper is stopped in either of those positions, the motor stalls and, with many prior actuators, the motor remains in the stalled condition and wastefully consumes electric power.

SUMMARY OF THE INVENTION

The general aim of the present invention is to provide a new and improved reversible rotary actuator in which novel torque-responsive switch means uniquely de-energize the motor when the motor stalls in either direction upon stopping of the output member in a limit position.

Another object of the invention is to provide a reversible torque-limiting actuator in which a single spring assures precise and reliable operation of the switch means and may be easily adjusted to effect de-energization of the motor when the resistance torque reaches different predetermined magnitudes.

Still another object is to provide a reversible actuator in which the switch means are prevented from oscillating between open and closed positions when the output member is stopped in a limit position.

The invention also resides in the relatively simple and trouble-free construction of the switch means and in the novel manner of actuating the switch means in response to the resistance torque exerted on the output member.

These and other objects and advantages of the invention will become more apparent from the following detailed description when taken in conjunction with the accompanying drawings.

DETAILED DESCRIPTION OF THE PREFERRED EMBODIMENT

Figure 1:
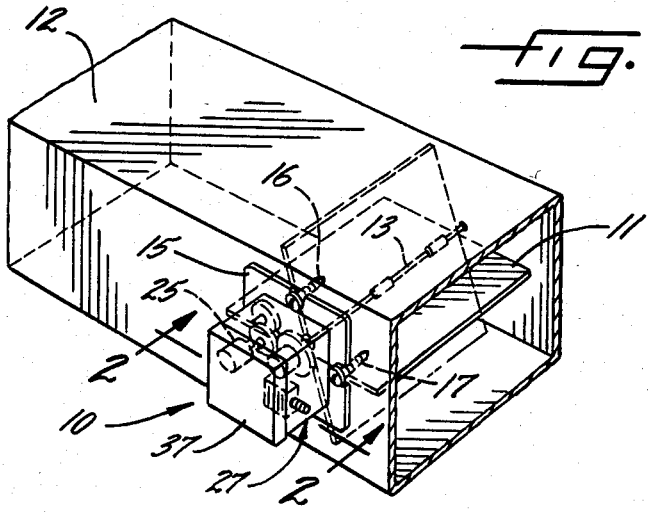
FIG. 1 is a perspective view showing a damper-controlled air duct equipped with a new and improved reversible rotary actuator incorporating the unique features of the present invention.
Figure 3:
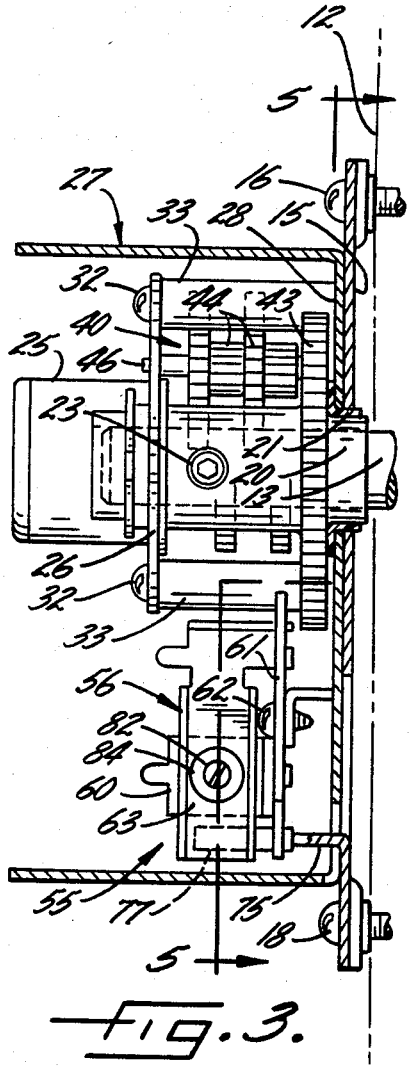
FIG. 3 is a fragmentary cross-section taken substantially along the line 3—3 of FIG. 2.

As shown in the drawings for purposes of illustration, the invention is embodied in a reversible rotary actuator 10 for controlling the position of an output member 11. In this particular instance, the output member 11 has been shown as being a flowcontrolling damper located in an air conditioning duct 12 and adapted to be turned between a fully open position shown in solid lines in FIG. 1 and a fully closed position shown in broken lines. To support the damper for such turning, a shaft 13 is connected rigidly to the damper and is journaled in the side walls of the duct. One end portion of the shaft extends through the adjacent side wall of the duct as shown in FIG. 3.

The actuator 10 includes a main mounting base 15 made of sheet metal and fastened to the outer side of one of the side walls of the duct 12 by four screws 16, 17, 18 and 19. Merely for simplicity of illustration, the inner end portion of the screw 16 has been shown in FIG. 1 as serving as a positive stop for holding the damper 11 in its fully closed position while the inner end portion of the screw 17 has been shown as serving as a positive stop for holding the damper in its fully open position.

Advantageously, the actuator 10 is adapted to be connected directly to the damper shaft 13 so as to avoid the need for connecting the actuator to the shaft with linkages or the like. For this purpose, the actuator includes a tubular output shaft 20 (FIGS. 3 and 4) which is rotatably journaled in the mounting base 15 by a nylon bushing 21 which extends through a hole 22 (FIG. 4) in the mounting base. The damper shaft 13 is telescoped into the tubular shaft 20 and is secured thereto by a set screw 23.

Figure 4:
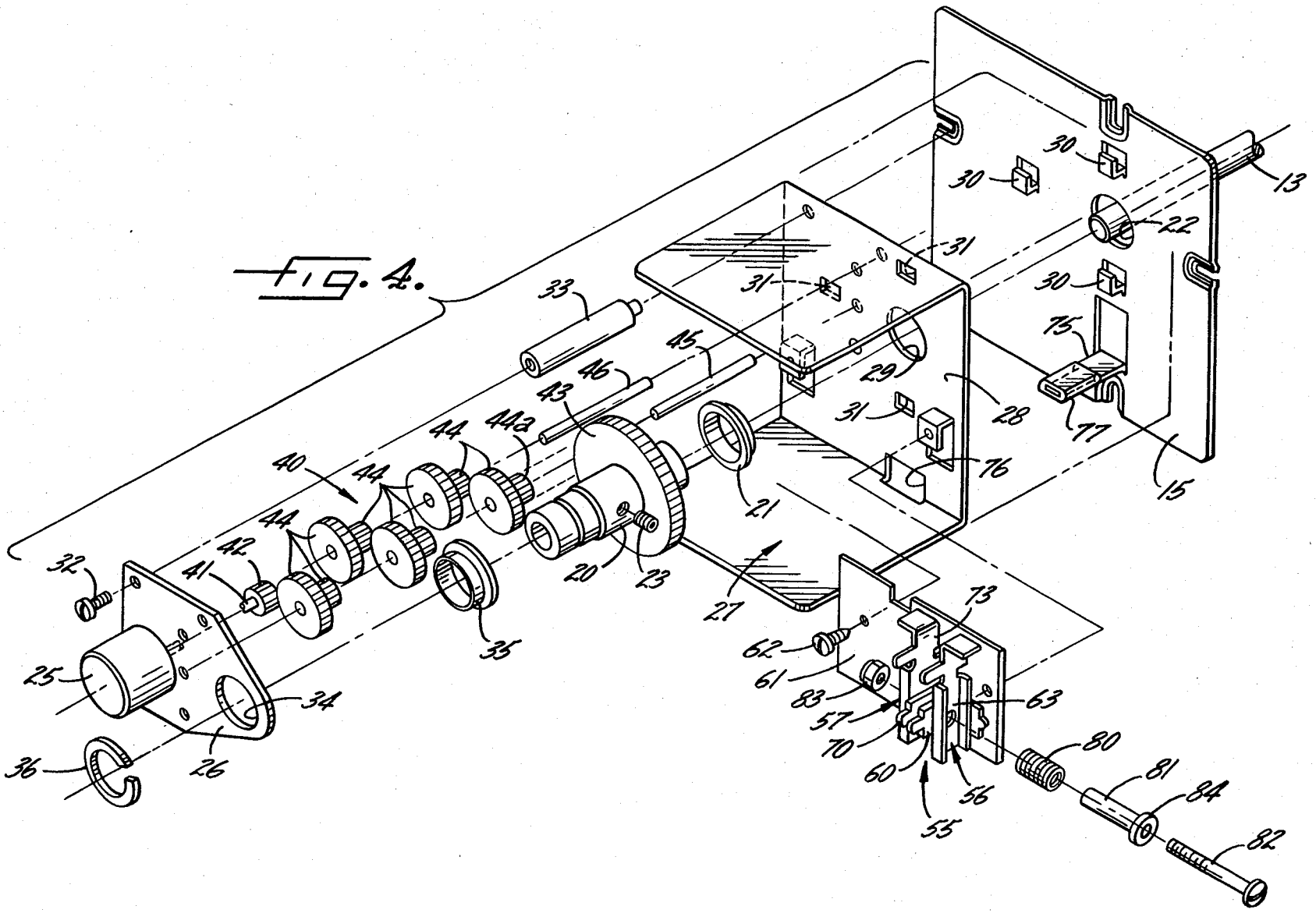
FIG. 4 is an exploded perspective view of certain parts of the actuator.

The output shaft 20 of the actuator 10 is adapted to be driven selectively in either a clockwise or counterclockwise direction by a reversible electric motor 25. As shown in FIGS. 3 and 4, the motor is supported by a plate 26 which forms part of a sub-base 27. The sub-base also includes a U-shaped sheet metal bracket having an inner plate 28 lying face-to-face against the mounting base 15 and formed with a hole 29 (FIG. 4) for receiving the bushing 21. Suitable tabs 30 struck from the mounting base 15 extend through holes 31 in the plate 28 to fasten the plate to the mounting base. The plate 28 of the sub-base 27 is secured rigidly to the plate 26 of the sub-base by screws 32 and spacers 33 extending between the two plates. The plate 26 is formed with a hole 34 (FIG. 4) which receives a nylon bushing 35 for journaling the outer end portion of the output shaft 20, there being a snap ring 36 on the shaft for holding the shaft, the plate 26 and the bushing 35 in assembled relation. A cover 37 (FIG. 1) may be connected to the sub-base 27 to enclose the various components of the actuator 10.

The motor 25 is connected to the output shaft 20 by a gear train 40 (FIG. 4) which causes the drive shaft 41 of the motor to rotate the output shaft in the same direction as the drive shaft but with reduced speed and increased torque. In this instance, the drive train includes a small input gear 42 on the motor shaft 41, a large output gear 43 integral with the output shaft 20, and ten intermediate gears 44 connected between the input and output gears. Six of the intermediate gears 44 are rotatable on a pin 45 extending between and secured to the plate 26 and 28 and located on a straight line extending between the axes of the output shaft 20 and the drive shaft 41 (see FIGS. 2 and 4). The other four intermediate gears 44 are rotatable on a parallel pin 46 which also extends between and is secured to the plates 26 and 28. The final or innermost intermediate gear 44*a* (FIG. 4) is a small gear which is offset from and which meshes directly with the output gear 43, the gear 44*a* being rotatable on the pin 45.

With the foregoing arrangement, the motor 25 is energized to turn its drive shaft 41 in a clockwise direction when, for example, a thermostat (not shown) causes switches 50 (FIG. 8) to close to connect the motor across a suitable voltage source. When the thermostat causes the switches 50 to open and causes switches 51 to close, the polarity is reversed so as to cause the motor to be energized to turn its drive shaft in a counterclockwise direction. In either direction of rotation, the input gear 42 on the drive shaft 41 acts through the intermediate gears 44 to turn the output gear 43, the output shaft 20 and the damper shaft 13 at a much lower speed than the drive shaft. The gearing is such that the output shaft 20 is rotated in the same direction as the drive shaft 41.

When the damper 11 reaches either of its limit positions and engages either of the stop screws 16 or 17, the motor 25 of the actuator 10 goes to a stalled condition. In many actuators of the foregoing general type, the motor is simply left in a stalled condition as long as the damper is in a limit position. This results in a waste of electric power and also can shorten the useful service life of the motor.

In accordance with the present invention, novel torque-responsive switch means 55 (FIG. 2) de-energize the motor 25 automatically whenever the damper 11 stops in a limit position and the resistance torque on the output shaft 20 reaches a predetermined value. The switch means are highly reliable and precise and may be easily adjusted to insure proper and timely de-energization of the motor.

Figure 2:
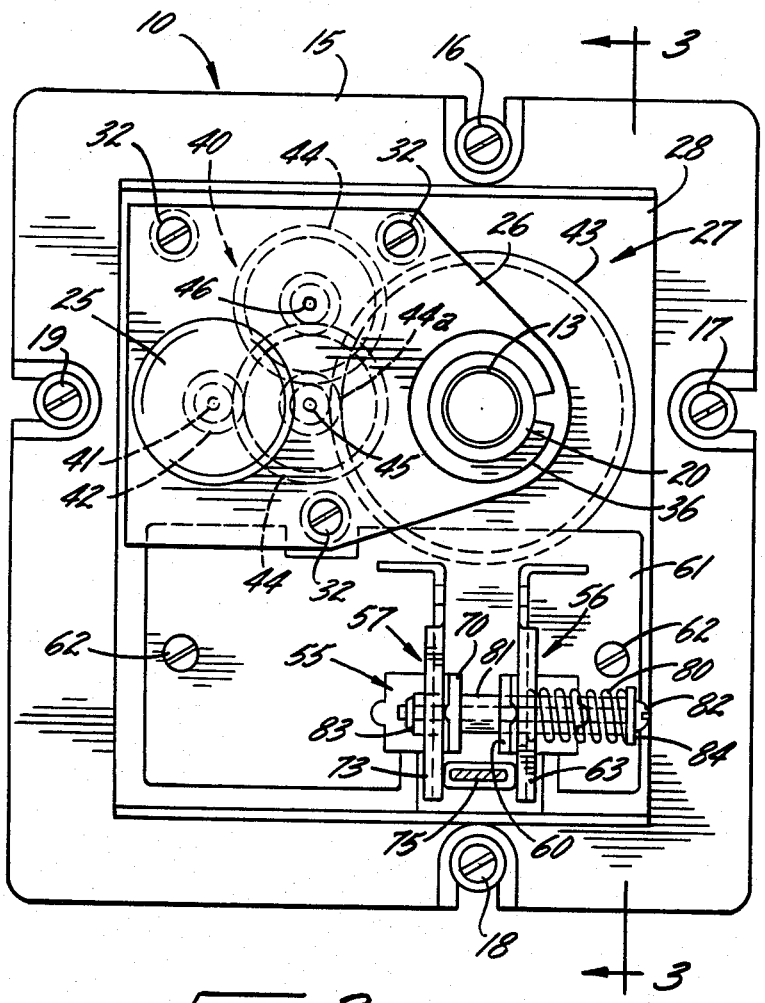
FIG. 2 is an enlarged cross-section taken substantially along the line 2—2 of FIG. 1.
Figure 8:
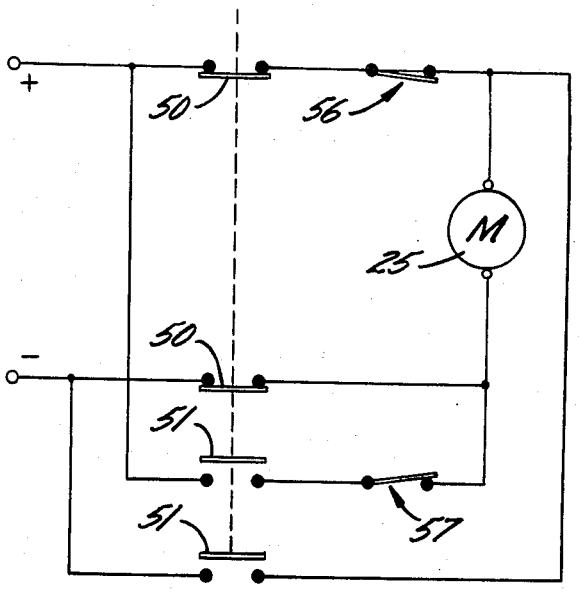
FIG. 8 is a diagram which schematically shows a simplified electrical circuit for controlling the motor of the actuator.

More specifically, the switch means 55 comprise a normally closed first switch 56 and a virtually identical normally closed second switch 57 (see FIGS. 2 and 8). The first switch 56 opens and effects de-energization of the motor 25 when the output shaft 20 stalls in a clockwise direction while the second switch 57 opens and effects de-energization of the motor when the output shaft stalls in a counterclockwise direction.

Figure 5:
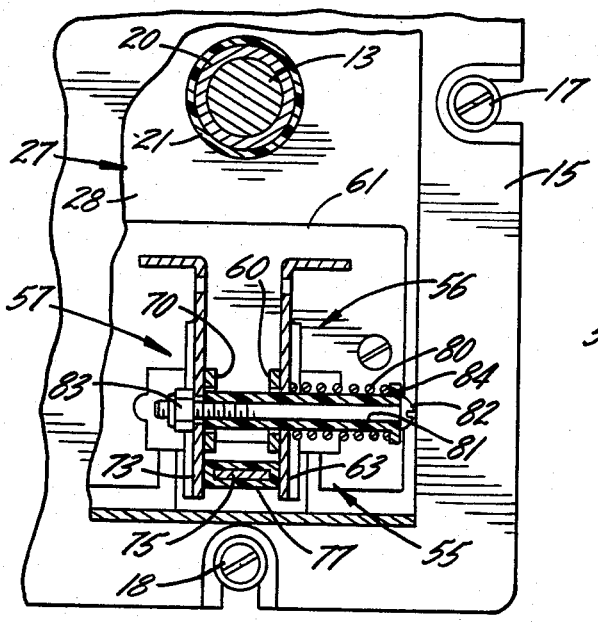
FIG. 5 is a fragmentary cross-section taken substantially along the line 5—5 of FIG. 3 and shows the switching means in their normally closed condition.
Figure 6:
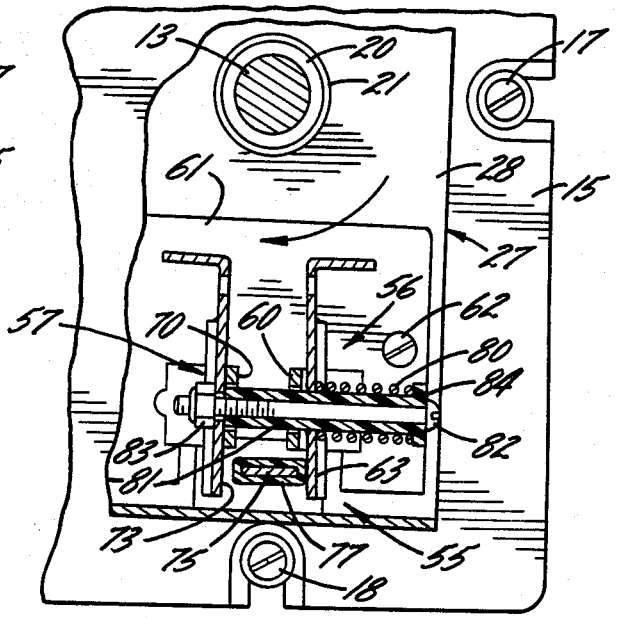
FIG. 6 is a view similar to FIG. 5 but shows the condition of the switching means when the output member is stopped in one limit position.

As shown most clearly in FIG. 4, the first switch 56 comprises a fixed switch contact 60 in the form of an L-shaped conductive member anchored to a printed circuit board 61 which is fastened rigidly to the plate 28 of the sub-base 27 by screws 62. The first switch 56 further comprises a movable switch contact 63 in the form of a generally L-shaped leaf spring having a fixed portion anchored to the circuit board and having a cantilevered portion adapted to flex clockwise toward and counterclockwise away from the fixed contact 60. The contacts 60 and 63 are connected electrically to one another by the printed circuit board 61 such that the switch 56 is closed to enable clockwise energization of the motor 25 by way of the switches 50 when the contact 63 engages the contact 60. When the contact 63 is flexed counterclockwise away from the contact 60 from the position shown in FIG. 5 to the position shown in FIG. 6, the switch 56 is opened to prevent clockwise energization of the motor even though the switches 50 are closed.

The switch 57 is very similar to the switch 56. Thus, the switch 57 includes a generally L-shaped fixed contact 70 anchored rigidly to the circuit board 61 and further includes a movable contact 73 in the form of a generally L-shaped leaf spring connected electrically with the contact 70 by the circuit board. The cantilevered portion of the contact 73 is adapted to flex counterclockwise (FIG. 2) toward the contact 70 to close the switch 57 and enable counterclockwise energization of the motor 25. When the contact 73 flexes clockwise away from the contact 70, the switch 57 is opened so as to prevent counterclockwise energization of the motor via the switches 51.

As shown in FIG. 2, the active portions of the contacts 60 and 70 are located directly between the cantilevered portions of the contacts 63 and 73. In addition, an electrically insulated tab 75 is located between the cantilevered portions of the contacts 63 and 73. The tab is struck from and is rigid with the main mounting base 15, extends through an opening 76 (FIG. 4) in the plate 28 and is protected by a suitable insulating jacket 77.

In carrying out the invention, the contacts 63 and 73 are urged into engagement with the contacts 60 and 70, respectively, and are urged toward the tab 75 by a single spring 80. Herein, the spring is in the form of a coiled compression spring telescoped over an insulating sleeve 81 which extends through holes in the contacts 63, 60 and 70. A screw 82 extends through the sleeve 81 and through a hole in the contact 73 and is held by a nut 83. When the screw 82 is tightened, the spring 80 is compressed between the contact 63 and a flange 84 (FIG. 4) on the end portion of the sleeve 81. Tightening of the screw 82 causes the spring 80 to flex the contact 63 clockwise into engagement with the contact 60 and toward one side of the tab 75 and also causes the nut 83 to flex the contact 73 counterclockwise into engagement with the contact 70 and toward the other side of the tab. When disposed in tight engagement with the contacts 60 and 70, the contacts 63 and 73 are spaced just a slight distance from the sides of the tab 75.

Pursuant to the invention, the exertion of excessive resistance torque on the output shaft 20 causes the sub-base 27 to turn relative to the main mounting base 15 and effect automatic opening of the appropriate pair of switch contacts 60 and 63 or 70 and 73. For this purpose, the plate 28 of the sub-base 27 is journaled to turn on the bushing 21 and about the axis of the output shaft 20. Such turning is permitted through a limited range by virtue of the tabs 30 (FIG. 4) on the base 15 fitting into the holes 31 of the plate 28 with circumferential clearance while still holding the base and the plate in secure face-to-face relation. As a result, the sub-base 27 and all components carried on the sub-base are capable of turning through a limited range relative to the main mounting base 15 about the axis of the output shaft 20.

To explain the operation of the actuator 10, assume that the damper 11 is in its fully open position and that the switches 50 close to effect clockwise energization of the motor 25 and clockwise rotation of the output shaft 20 and the damper. When the final intermediate gear 44*a* initially applies clockwise torque to the output gear 43, the intermediate gear may attempt to walk clockwise a very short distance around the output gear with the reaction force from such walking being transmitted through the pin 45 to the sub-base 27. As a result, a clockwise turning force of very low magnitude is applied to the sub-base 27 to turn the sub-base clockwise through a very short distance relative to the main mounting base 15 and to turn the contact 63 into engagement with the tab 75 on the mounting base (see FIG. 5). Once the contact 63 engages the tab 75, the force of the compressed spring 80 resists any further clockwise turning of the sub-base and holds the contact 63 in tight engagement with the contact 60 so as to enable continued clockwise energization of the motor 25.

When the contact 63 engages the tab 75, the intermediate gear 44*a* applies full torque to the output gear 43 to turn the output shaft 20 and the damper 11 in a clockwise direction. As long as the damper is free to turn, any reaction force transmitted to the sub-base 27 through the pin 45 is insufficient to overcome the preload of the spring 80 and effect turning of the sub-base 27 relative to the main base 15.

When the damper 11 turns to its fully closed position and stops against the screw 16, resistance torque of high magnitude is applied to the output shaft 20. Since the stopped output gear 43 cannot turn, the torque from the motor 25 causes the intermediate gear 44*a* to attempt to walk clockwise around the output gear. Accordingly, a relatively high reaction force is exerted on the sub-base 27 through the pin 45. That high reaction force overcomes the preload of the spring 80 and thus the spring yields or compresses to permit the reaction force to turn the sub-base 27 clockwise relative to the main base 15. As a result, the contact 60 moves clockwise away from the contact 63 from the position shown in FIG. 5 to the position shown in FIG. 6. During such movement, the cantilevered portion of the contact 63 remains stopped against the fixed tab 75 but flexes counterclockwise to permit the anchor portion of the contact 63 to move with the circuit board 61 and the sub-base 27. Once the contact 60 moves away from the contact 63, the switch 56 opens to de-energize the motor 25.

Importantly, the contact 60 remains out of engagement with the contact 63 until the switches 51 are closed to effect counterclockwise energization of the motor 25. In other words, the switch 56 remains open as long as the switches 51 are open and does not repeatedly oscillate between open and closed positions. Thus, even though the compressed spring 80 attempts to turn the sub-base 27 counterclockwise, the ratio of the gear train 40 prevents the intermediate gear 44*a* from walking counterclockwise around the output gear 43 and effecting reverse turning of the sub-base to bring the contact 60 back into engagement with the contact 63. Accordingly, the motor 25 remains de-energized until such time as the switches 51 are closed.

Figure 7:
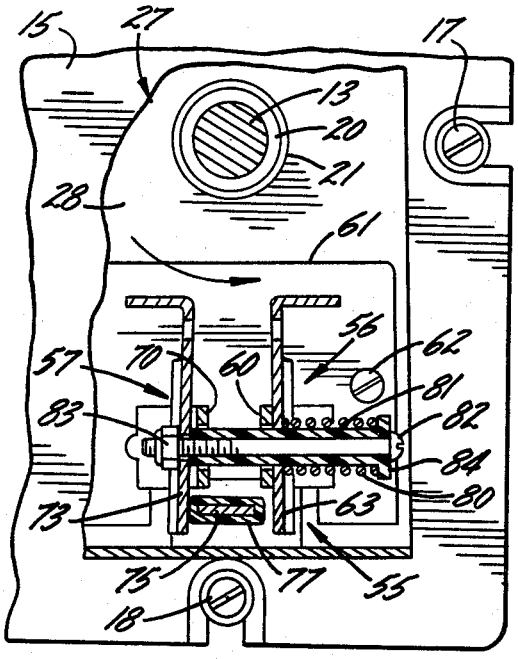
FIG. 7 also is a view similar to FIG. 5 but shows the condition of the switching means when the output member is stopped in its opposite limit position.

The actuator 10 operates in a similar but reverse manner when the switches 51 are closed to effect counterclockwise turning of the damper 11 from its closed position to its open position. Upon initial counterclockwise energization of the motor 25, the intermediate gear 44*a* attempts to walk counterclockwise around the output gear 43 so as to turn the sub-base 27 counterclockwise and bring the contact 60 back into engagement with the contact 63 while also bringing the contact 73 into engagement with the tab 75. Thereafter, the spring 80 prevents further counterclockwise turning of the sub-base until the damper 11 engages the stop screw 17 to effect stopping of the output shaft 20. As an incident thereto, the intermediate gear 44*a* tends to walk counterclockwise around the output gear 43 with the relatively high reaction force being transmitted through the pin 45 to turn the sub-base 27 counterclockwise against the force of the spring 80 from the position shown in FIG. 5 to the position shown in FIG. 7. The contact 70 thus moves away from and opens relative to the cantilevered contact 73, which flexes clockwise with respect to its anchor position (see FIG. 7).

From the foregoing, it will be apparent that the present invention brings to the art a new and improved reversible rotary actuator 10 in which the switch means 55 automatically de-energize the motor 25 when the resistance torque on the output shaft 20 reaches a predetermined magnitude in either direction of rotation. Both switches 56 and 57 are reliably controlled by the single spring 80 whose preload may be easily and precisely changed simply by adjusting the screw 82. Thus, the spring can be adjusted to insure that the switches 56 and 57 will remain closed until the output shaft 20 encounters resistance torque of a predetermined magnitude.

I claim:

1. A reversible rotary actuator comprising a mounting base adapted to be anchored in a fixed position, a sub-base supported on said mounting base to turn relative to said mounting base about a predetermined axis, an output shaft journaled by said mounting base to rotate relative to said mounting base and said sub-base, a reversible electric motor carried by said sub-base and selectively operable to drive said output shaft either clockwise or counterclockwise, first and second normally closed switch means which are operable when opened to prevent energization of said motor in clockwise and counterclockwise directions, respectively, and stop means fixed to said mounting base for opening said first switch means in response to turning of said sub-base in one direction about said axis and for opening said second switch means in response to turning of said sub-base in the opposite direction about said axis, each of said switch means comprising one switch contact fixed to said sub-base and further comprising an additional switch contact having one portion fixed to said sub-base and having a cantilevered portion adapted to flex between open and closed positions relative to said one portion.

2. A reversible rotary actuator as defined in claim 1 in which said stop means comprises a stop member fixed to said mounting base and located between the cantilevered portions of said contacts.

3. A reversible rotary actuator as defined in claim 3 further including spring means for biasing the cantilevered portions of said contacts toward said stop member.

4. A reversible rotary actuator as defined in claim 3 in which said spring means consists of a single coiled compression spring.

5. A reversible rotary actuator as defined in claim 1 in which the axis about which said sub-base turns coincides with the axis of said output shaft.

6. A reversible rotary actuator comprising a mounting base adapted to be anchored in a fixed position, an output shaft jornaled by said mounting base to rotate relative to said mounting base about a predetermined axis coinciding with the axis of the shaft, a sub-base supported on said mounting base to turn relative to said mounting base and said shaft about said axis, a reversible electric motor fixed to and turnable with said sub-base and having a rotatable drive shaft, a gear train connecting said drive shaft to said output shaft, first and second spaced switch contacts fixed rigidly to and turnable with said sub-base, third and fourth switch contacts fixed to and turnable with said sub-base but movable relative to said sub-base between closed and open positions with respect to said first and second switch contacts, respectively, said first and second contacts being located between said third and fourth contacts in position to be engaged by such contacts, a fixed stop anchored rigidly to said base and also located between said third and fourth contacts in position to be engaged by such contacts, and preloaded spring means urging said third and fourth contacts toward one another to closed positions against said first and second contacts, respectively, and urging said third and fourth contacts toward said stop, said spring means yielding and permitting said sub-base to turn on said base when the torque exerted on said output shaft exceeds the preload of said spring means.

7. A reversible rotary actuator comprising a mounting base adapted to be anchored in a fixed position, an output shaft journaled by said mounting base to rotate relative to said mounting base about a predetermined axis coinciding with the axis of the shaft, a sub-base supported on said mounting base to turn relative to said mounting base and said shaft about said axis, a reversible electric motor fixed to and turnable with said sub-base and having a rotatable drive shaft, a gear train connecting said drive shaft to said output shaft, said gear train comprising (a) an input gear rotatable with said drive shaft, (b) an output gear rotatable with said output shaft, and (c) a series of intermediate gears drivingly connecting said input gear to said output gear, one of said intermediate gears meshing with said output gear and being supported on said sub-base to walk around said output gear and to force said sub-base to turn relative to said base about said axis when said output gear is stopped and said input gear is rotated, first and second spaced switch contacts fixed rigidly to and turnable with said sub-base, a third switch contact fixed to and turnable with said sub-base but movable relative to said sub-base between closed and open positions with respect to said first switch contact to enable and disable energization of said motor in one direction, a fourth switch contact fixed to and turnable with said sub-base but movable relative to said sub-base between closed and open positions with respect to said second switch contact to enable and disable energization of said motor in the opposite direction, said first and second contacts being located between said third and fourth contacts in position to be engaged by such contacts, a fixed stop anchored rigidly to said base and also located between said third and fourth contacts in position to be engaged by such contacts, and preloaded spring means urging said third and fourth contacts toward one another to closed positions against said first and second contacts, respectively, and urging said third and fourth contacts toward said stop, said spring means yielding and permitting said sub-base to turn on said base to force said third contact against said stop when the clockwise torque exerted on said output shaft exceeds the preload of said spring means whereby said third contact opens with respect to said first contact to disable energization of said motor in said one direction, and said spring means yielding and permitting said sub-base to turn oppositely on said base to force said fourth contact against said stop when the counterclockwise torque exerted on said output shaft exceeds the preload of said spring means whereby said fourth contact opens with respect to said second contact to disable energization of said motor in said opposite direction.

8. A reversible rotary actuator as defined in claim 7 in which each of said third and fourth contacts comprises a resiliently yieldable leaf spring having a fixed portion anchored to said sub-base and having a movable portion adapted to flex back and forth relative to said fixed portion.

9. A reversible rotary actuator as defined in claim 8 in which said spring means consists of a single coiled compression spring acting on the cantilevered portions of said contacts to bias said cantilevered portions toward said stop.

10. A reversible rotary actuator comprising a mounting base adapted to be anchored in a fixed position, a sub-base supported on said mounting base to turn relative to said mounting base about a predetermined axis, an output shaft journaled by said mounting base to rotate relative to said mounting base and said sub-base about an axis coinciding with said predetermined axis, a reversible electric motor carried by said sub-base and selectively operable to rotate said output shaft in either direction, first and second switch means carried on said sub-base to turn with said sub-base, axially and radially fixed stop means attached rigidly to said mounting base and located between said switch means for actuating said first switch means in response to turning of said sub-base in one direction about said predetermined axis and for actuating said second switch means in response to turning of said sub-base in the opposite direction about said predetermined axis, and a preloaded compression spring extending generally along the directions of turnig of said sub-base and normally holding the sub-base against turning, said spring yielding and permitting said sub-base to turn about said predetermined axis when the torque exerted on said output shaft in either direction exceeds the preload of said spring.

* * * * *